US008640938B2

(12) United States Patent
Toulouse et al.

(10) Patent No.: US 8,640,938 B2
(45) Date of Patent: Feb. 4, 2014

(54) FIXING APPLIANCE WITH INTERNAL COMBUSTION ENGINE WITH REGULATING THERMISTOR

(75) Inventors: Bruno Toulouse, Tain l'Hermitage (FR); Patrick Herelier, Saint Jean de Muzols (FR); Michel Gleizolles, Saint Marcel les Valence (FR)

(73) Assignee: Societe de Prospection et d'Inventions Techniques Spit, Bourg les Valence (FR)

( * ) Notice: Subject to any disclaimer, the term of this patent is extended or adjusted under 35 U.S.C. 154(b) by 1057 days.

(21) Appl. No.: 11/569,567

(22) PCT Filed: May 26, 2005

(86) PCT No.: PCT/IB2005/001452
§ 371 (c)(1),
(2), (4) Date: Nov. 22, 2006

(87) PCT Pub. No.: WO2005/115697
PCT Pub. Date: Dec. 8, 2005

(65) Prior Publication Data

US 2007/0267456 A1 Nov. 22, 2007

(30) Foreign Application Priority Data

May 27, 2004 (FR) ..... 04 05714

(51) Int. Cl.
*B25C 1/08* (2006.01)

(52) U.S. Cl.
USPC ..... 227/10; 227/9; 227/130

(58) Field of Classification Search
USPC ..... 227/9, 10, 11, 2, 130, 120; 123/46 SC
See application file for complete search history.

(56) References Cited

U.S. PATENT DOCUMENTS

| | | | | |
|---|---|---|---|---|
| 4,955,431 | A * | 9/1990 | Saur et al. | 165/271 |
| 5,462,359 | A * | 10/1995 | Reichl et al. | 374/148 |
| 5,713,313 | A | 2/1998 | Berry | |
| 5,909,836 | A | 6/1999 | Shkolnikov et al. | |
| 6,123,241 | A | 9/2000 | Walter | |

(Continued)

FOREIGN PATENT DOCUMENTS

| | | |
|---|---|---|
| CN | 1217967 A1 | 6/1999 |
| CN | 1532027 A1 | 9/2004 |

(Continued)

OTHER PUBLICATIONS

Corrected International Search Report and Written Opinion dated Sep. 26, 2006.

(Continued)

*Primary Examiner* — Alexandra Elve
*Assistant Examiner* — Nathaniel Chukwurah
(74) *Attorney, Agent, or Firm* — Lowe Hauptman & Ham, LLP

(57) ABSTRACT

The appliance comprises a piston mounted in a cylinder of an internal combustion engine and forming, with a cylinder head, a combustion chamber in which there is disposed a mixing, emptying and cooling fan associated with an electric drive motor (8) connected to an electronic management module and to a supply battery. It also comprises, close to the fan motor (8), a thermistor (12) sensitive to the temperature provided for transmitting the temperature information to the management module.

6 Claims, 2 Drawing Sheets

(56) References Cited

U.S. PATENT DOCUMENTS

Figure 1:
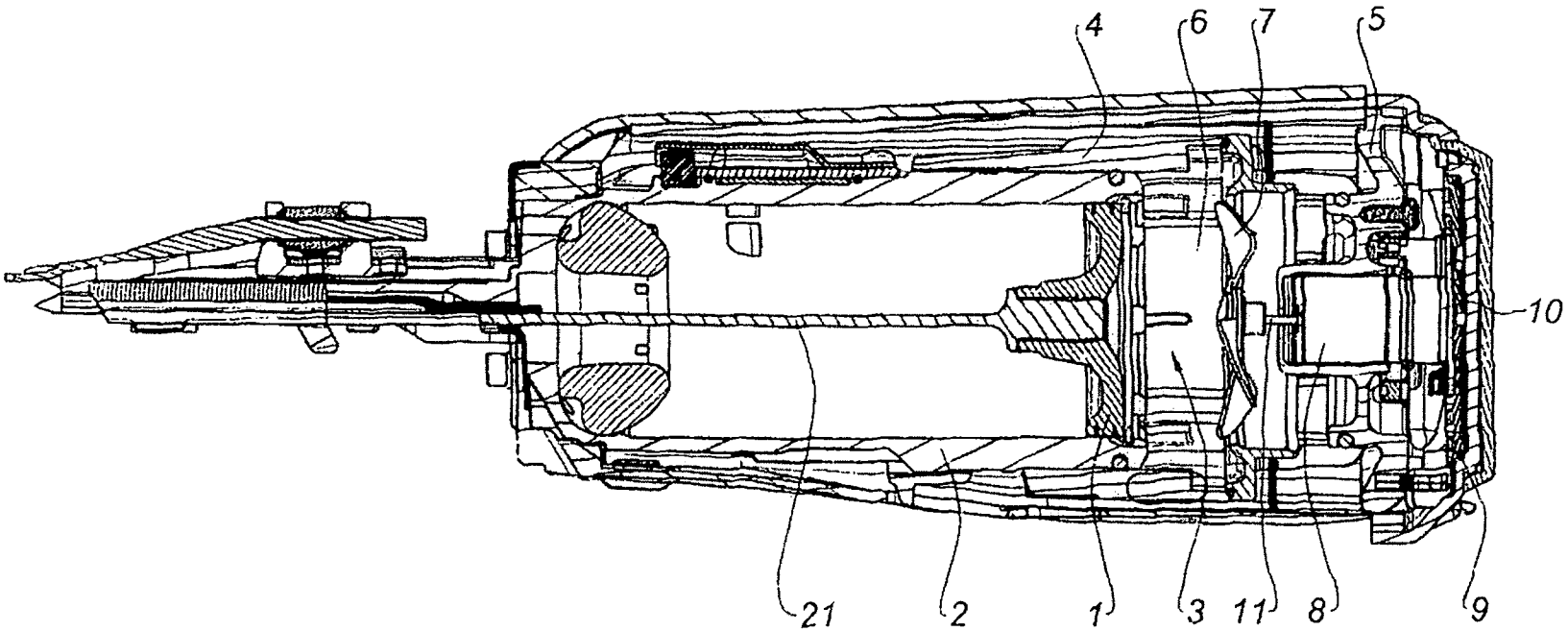

| | | | | |
|---|---|---|---|---|
| 6,164,510 | A | 12/2000 | Deieso et al. | |
| 6,247,626 | B1 | 6/2001 | MacVicar | |
| 6,588,931 | B2 * | 7/2003 | Betzner et al. | 374/185 |
| 6,619,527 | B1 * | 9/2003 | Moeller | 227/10 |
| 6,739,490 | B1 | 5/2004 | Shkolnikov et al. | |
| 6,783,047 | B2 * | 8/2004 | Granacher | 227/10 |
| 7,021,251 | B2 | 4/2006 | Ohmori et al. | |
| 7,036,704 | B2 * | 5/2006 | Nayrac et al. | 227/10 |
| 2004/0045997 | A1 * | 3/2004 | Birk et al. | 227/2 |
| 2004/0182336 | A1 * | 9/2004 | Ohmori et al. | 123/46 R |
| 2006/0261122 | A1 * | 11/2006 | Moeller et al. | 227/10 |

FOREIGN PATENT DOCUMENTS

| | | | |
|---|---|---|---|
| EP | 0579241 | A | 1/1994 |
| EP | 0597241 | A | 5/1994 |
| EP | 1375075 | A | 1/2004 |
| EP | 1459850 | A | 9/2004 |
| JP | 05-333658 | A | 12/1993 |
| JP | 10225875 | A | 8/1998 |
| JP | 2000354979 | A | 12/2000 |
| JP | 2002144253 | A | 5/2002 |
| JP | 2004025441 | A | 1/2004 |
| JP | 2004-117732 | A | 4/2004 |
| JP | 2004510590 | A | 4/2004 |
| JP | 2004510590 | T | 4/2004 |
| JP | 2004314263 | A | 11/2004 |
| WO | 02/16085 | A1 | 2/2002 |

OTHER PUBLICATIONS

Chinese Patent No. CN1953847 issued Sep. 19, 2012.
Office Action for JP2007-514170 mailed Aug. 30, 2011.
Office Action for corresponding JP2007-514170 mailed Feb. 15, 2011.

* cited by examiner

FIXING APPLIANCE WITH INTERNAL COMBUSTION ENGINE WITH REGULATING THERMISTOR

RELATED APPLICATIONS

The present application is a National Phase entry of International Application Number PCT/IB2005/001452, filed May 26, 2005, which claims priority from, French Application Number 0405714, filed May 27, 2004.

The invention concerns fixing appliances with driving of fixing elements by a piston propelled in a cylinder of an internal combustion engine, forming, with a cylinder head, a combustion chamber in which there is disposed a mixing, emptying and cooling fan. This is because the fan serves first of all to obtain the flammable mixture of gas and air; it also serves to empty the combustion chamber of the combustion residues; finally, the fan also serves to cool all the components which may have heated up during ignition and, in particular, the cylinder, the piston, the cylinder head and the other components constituting the combustion chamber.

Today, the sum of the emptying and cooling periods, after ignition, during which the fan continues to be driven in rotation, is determined as soon as the appliance is designed and fixed in the factory. This is regrettable.

The thermal realities are not taken into account.

The ideal would be to dispose a temperature sensor on the cylinder. This design would be expensive and in any event difficult to implement. As for the solution of providing a sensor on another component of the engine, this also would not be easy to implement.

Wishing then to improve the cooling conditions of the fixing appliances introduced above, the applicant had the idea of wishing to profit from the fact that the fan motor is connected to an electronic management module and to the battery supplying the appliances and thus it proposes its invention.

The invention therefore concerns a fixing appliance with driving of fixing elements by a piston mounted in a cylinder of an internal combustion engine and forming, with a cylinder head, a combustion chamber in which a mixing, emptying and cooling fan is disposed, associated with an electric drive motor connected to an electronic management module and to a supply battery, an appliance characterised by the fact that it comprises, close to the fan motor, a thermistor sensitive to the temperature provided for transmitting the temperature information to the management module.

The management module, which, advantageously, comprises a processor, manages the temperature information supplied by the thermistor in order to determine the period of functioning of the fan after ignition according to this temperature, for example by means of a ventilation and temperature duration table.

In the preferred embodiment of the appliance of the invention, the fan motor is connected to the management module by a connecting circuit and the thermistor is mounted on this connecting circuit, in principle a printed circuit.

This solution is easy to implement since it suffices, apart from the installation of the thermistor, to provide an additional terminal on the connector of the connecting circuit for transmitting the temperature information.

Figure 2:
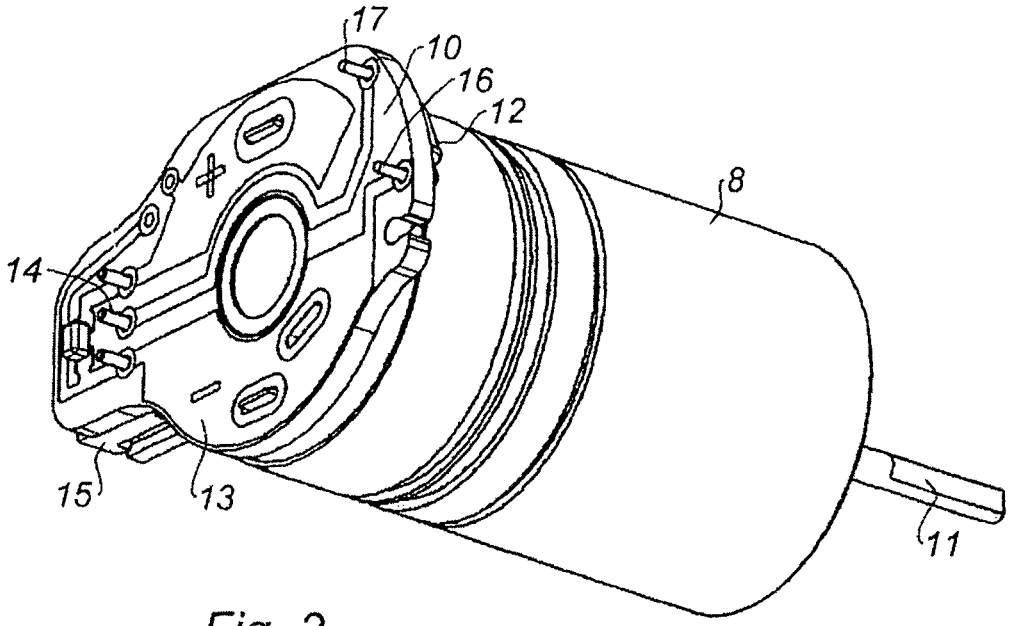
Figure 3:
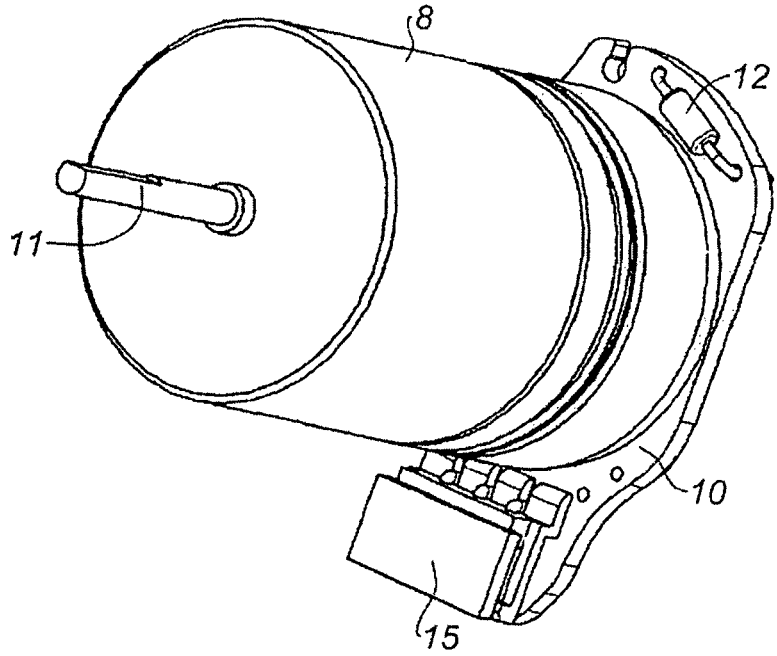

The invention will be better understood by means of the following description of the preferred embodiment of the appliance of the invention, with reference to the accompanying drawing, in which FIG. 1 is a view in longitudinal section of the appliance;

FIG. 2 is a rear perspective view of the fan motor of the appliance of FIG. 1, showing the printed circuit connecting the motor to the electronic management module of the appliance, and FIG. 3 is a front perspective view of the motor of FIG. 2, showing the thermistor mounted on the printed circuit.

The appliance which will now be described, for all that conventional in almost all its elements, is an appliance intended to drive fixing elements by means of a piston 1, to which there is fixed a propulsion rod 21, the piston 1 being mounted in a cylinder 2 of an internal combustion engine 3, the cylinder 2 forming, with a sleeve 4, in which it is slidably mounted, and a cylinder head 5, a combustion chamber 6. A fan 7 is disposed in the chamber 6 in order to fulfil a mixing function and obtain a good flammable mixture, an emptying function for emptying the combustion chamber of the combustion residues and also a function of cooling the components which have heated up during the ignition.

The fan 7, in a manner known per se, is rotated by a motor 8, on the shaft 11 of which it is mounted, the motor being mounted in the cylinder head 5 and being connected to an electronic management module 9 and to the electrical supply battery (not shown) by a printed circuit 10.

On the side of the printed circuit here turned towards the front there is mounted a regulating thermistor 10 whose lugs 16, 17 are respectively connected to an earthing area 13 of the printed circuit and to a terminal 14 of a connector 15 for connection to the management module 9, therefore providing the connection of the thermistor 12 and management module 9. In this way, and a processor (not shown) being installed in the management module 9, the temperature information supplied by the thermistor 12 can be processed in order to determine the correct duration of functioning of the fan 7 after ignition.

The invention claimed is:

1. A fixing appliance for driving fixing elements, said appliance comprising:

a cylinder of an internal combustion engine; a piston moveably mounted in a front part of the cylinder; a cooling fan mounted in a combustion chamber at a rear part of the cylinder; an electric drive motor connected to rotate said fan; an electronic management module and a supply battery electrically coupled to the motor for controlling and powering operations of the motor, respectively; and a thermistor sensitive to temperature and electrically connected to the electronic management module for transmitting temperature information to the electronic management module which is arranged to manage the temperature information supplied by the thermistor in order to determine an operating period of the fan after ignition according to the temperature information; wherein the thermistor is positioned rearward of said fan: and wherein the electric drive motor is connected to the electronic management module by a connecting circuit located at a rear end of said motor and the thermistor is directly mounted on the connecting circuit.

2. An internal-combustion-powered fixing appliance for driving fixing elements, said appliance comprising:

a cylinder;

a piston moveably mounted in a front part of the cylinder;

a cooling fan in a combustion chamber at a rear part of the cylinder;

an electric drive motor positioned rearward and outside of said combustion chamber, said motor having a motor shaft which extends forward from a front end of the motor and on which said fan is mounted;

an electronic management module coupled to the motor for controlling an operation of the fan;

a board positioned at a rear end of the motor and containing thereon a circuit that electrically couples the motor with the electronic management module; and a temperature sensor mounted directly on said board, sensitive to temperature and electrically connected to the electronic management module via said circuit for transmitting detected temperature information to the electronic management module which is arranged to control the operation of the fan in accordance with the detected temperature information.

3. The appliance according to claim 2, wherein said temperature sensor is positioned on a front side of the board that faces the fan.

4. The appliance according to claim 3, wherein said circuit is a printed circuit printed on a rear side of the board.

5. The appliance according to claim 4, wherein said temperature sensor is a thermistor having two lugs that extend through the board from the front side to the rear side and are electrically coupled to the circuit at the rear side of the board.

6. The appliance according to claim 3, wherein said temperature sensor is a thermistor and said electronic management module comprises a processor to determine an operating period of the fan after ignition according to the temperature information supplied by the thermistor.

* * * * *